US005638643A

United States Patent [19]

Demartini et al.

[11] Patent Number: 5,638,643

[45] Date of Patent: Jun. 17, 1997

[54] NEW AND USEFUL IMPROVEMENTS IN RAIN GUTTER DEVICES AND METHODS OF MAKING SAME

[76] Inventors: Robert J. Demartini, 208 Pineholt La., Flat Rock, N.C. 28731; David R. Demartini, 2646 Lunada La., Alamo, Calif. 94507

[21] Appl. No.: 453,335

[22] Filed: May 30, 1995

[51] Int. Cl.[6] ..... E04D 13/064

[52] U.S. Cl. ..... 52/11; 52/15; 52/58

[58] Field of Search ..... 52/11, 15, 58

[56] References Cited

U.S. PATENT DOCUMENTS

| | | | |
|---|---|---|---|
| 4,241,548 | 12/1980 | Rowe | 52/11 |
| 4,311,292 | 1/1982 | Deason | 52/11 X |
| 4,445,301 | 5/1984 | Tanski | 52/11 |
| 4,446,658 | 5/1984 | Gouin | 52/11 |
| 4,669,232 | 6/1987 | Wyatt | 52/11 |
| 4,696,131 | 9/1987 | Schreffler | 52/11 |
| 4,912,888 | 4/1990 | Martin | 52/11 X |
| 5,154,025 | 10/1992 | Brown | 52/58 |
| 5,216,852 | 6/1993 | Bemis et al. | 52/11 X |

OTHER PUBLICATIONS

"Terrain Crescent" sales brochure for classic half-round systems utilizing rain gutters. Product of Terrain, Aylesford, Kent, England.

*Primary Examiner*—Carl D. Friedman
*Assistant Examiner*—Yvonne Horton-Richardson
*Attorney, Agent, or Firm*—William G. Rhines, Esq.

[57] ABSTRACT

Elongated, trough-like rain gutters devices and methods of making same are disclosed, made from material by which they and/or their constituent components are rendered (1) formable into desired natural configurations, (2) coilable in their long dimension after having been formed without substantial residual elastic deformation from their natural configurations, and (3) uncoilable. The material is substantially impervious to the passage of water and has residual memory by which, when unaffected by external influences, to resume the natural configurations. Thus, they may be coiled to facilitate shipping and handling and unrolled without substantial residual deformation. They may be comprise one or more constituent members. Those comprising more than one may include a wall-facing structure and a main body structure, each of which structures is made up from at least one member, with the constituent members in edge to edge seriatim arrays. Interconnection means between members permit them to be angularly disposed with respect to each other and prevent water from passing between them. The interconnection means may optionally comprise a continuous flexible hinge member, formed simultaneously and integrally with the element(s) which it interconnects from the same or different material, or may be formed by cooperating elements that are integral with and along the adjacent edges of juxtaposed members and permit the members to move relative to each other.

30 Claims, 4 Drawing Sheets

FIG. 4
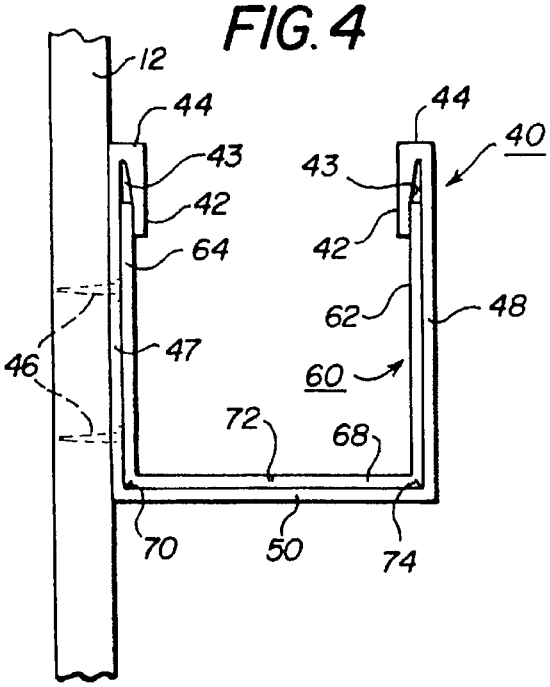
FIG. 5
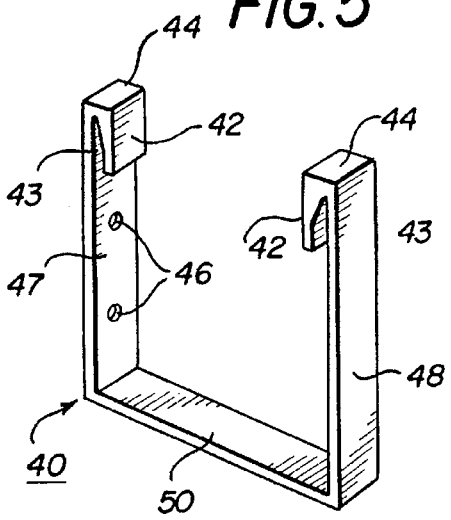
FIG. 7A
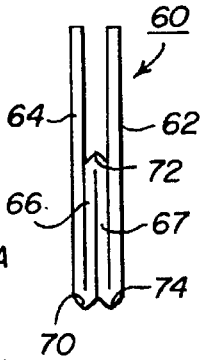
FIG. 7B
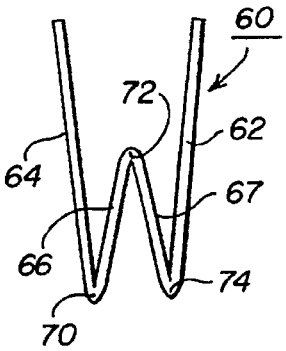
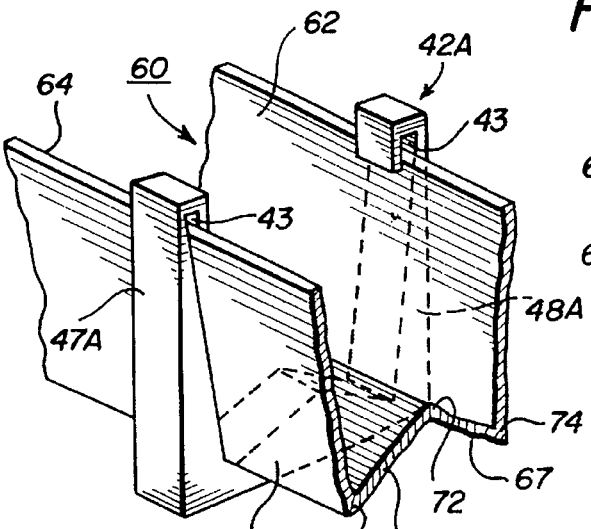
FIG. 6
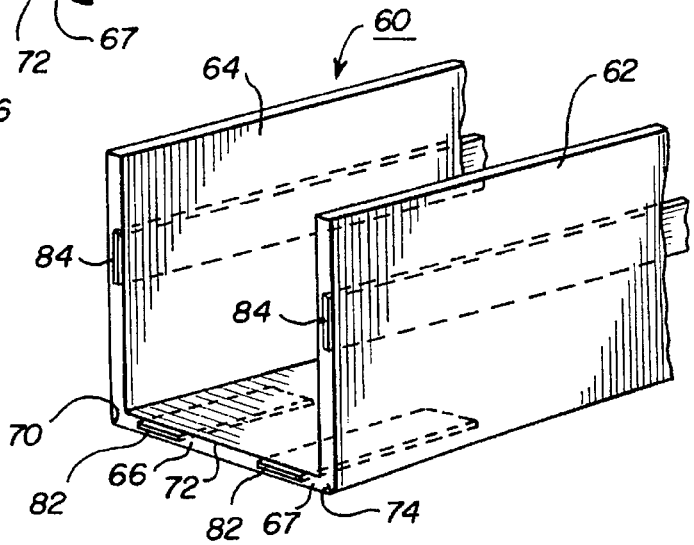
FIG. 8

FIG. 9
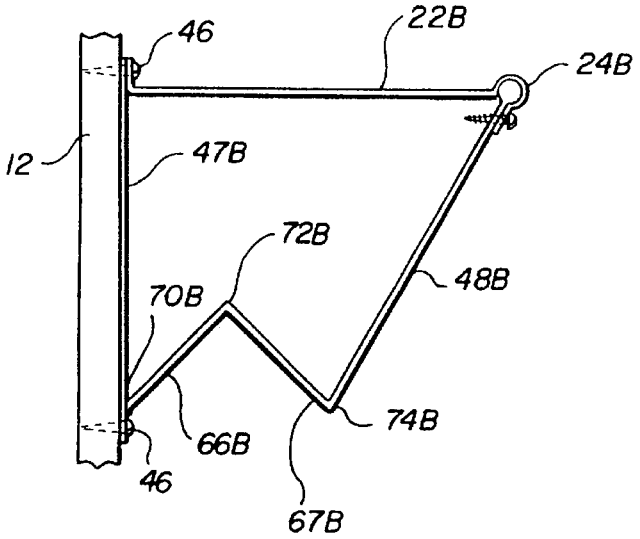
FIG. 13
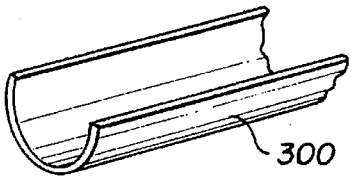
FIG. 11A
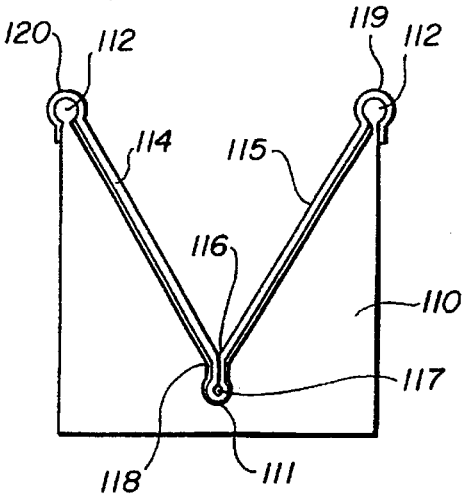
FIG. 10
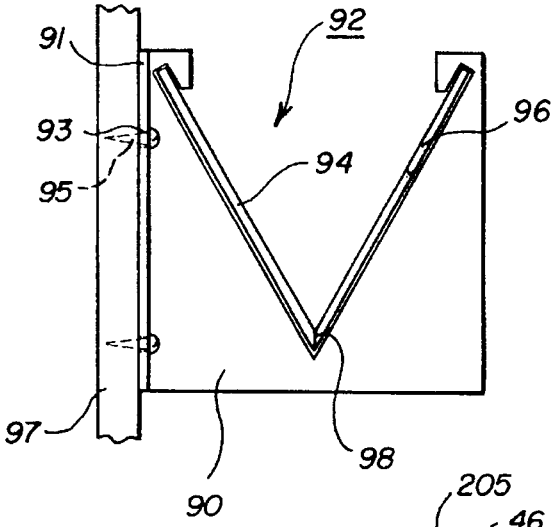
FIG. 11B
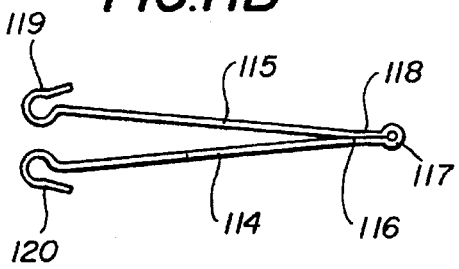
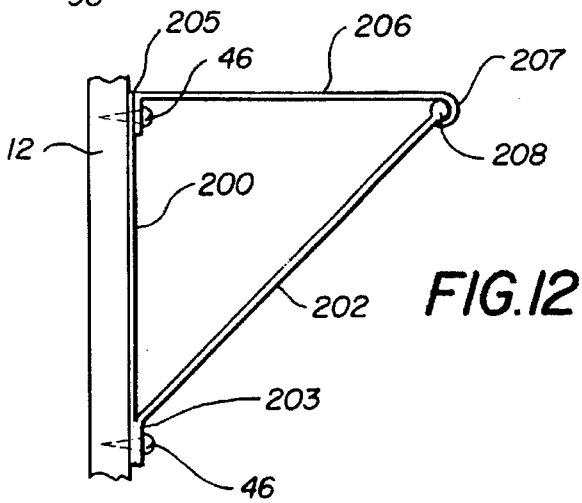
FIG. 12

NEW AND USEFUL IMPROVEMENTS IN RAIN GUTTER DEVICES AND METHODS OF MAKING SAME

BACKGROUND OF INVENTION

It is usual in constructing buildings to install a rain gutter at the top of selected sidewalls to carry rain water being discharged from the roof of the building to a downspout or other discharge facility via which the water is carried away. In the past, such gutters have been constructed from wood, or sheet metal such as galvanized steel, copper, aluminum, etc., or, more recently, plastic. Typically, such materials are prefabricated in standard lengths that are joined together at the installation site to form desired lengths. More recently, however, in the interests of minimizing leakage, improving the appearance of the finished installation, and reducing installation labor, alternative means have evolved to fabricate continuous gutters of desired total lengths. Such structures may be fabricated to order at a factory and shipped in the desired lengths. More commonly, they are roll-formed from strip stock into required lengths at the installation site, using portable equipment and rolls or coils of sheet metal as feed stock. This alternative is relatively expensive, in large part because of the high cost of the vehicle mounted roll-forming equipment that is used to produce the desired end product. More importantly, however, this approach effectively restricts the choice of materials that can be utilized to metals since the strip stock used must be susceptible to being easily shippable, while at the same time it must also be capable of being easily formed in the field into the desired end configurations which they will retain after having been so formed, preferably using known per se forming equipment. Plastic has several desirable properties, such as water tolerance and impermeability, durability, low maintenance with good appearance, resilience, and stability to the water, chemical and other exposures to which rain gutters are subjected. However, strip stock made from plastic has not been available in a form that is susceptible to being easily and economically shipped, and, at the same time, is capable of being formed at the installation site into long, inherently shape-stable lengths that are aesthetically acceptable as rain gutter shape. The desirability of using plastic materials in such applications, but their inability to date simultaneously to meet these criteria is demonstrated by their having been proposed in applications which are supplementary or ancillary to traditional rain gutters, but not as traditionally shaped, shape-stable, site-formable rain gutters per se. These include plastic sheet for installation in existing rigid gutters that have sprung leaks (e.g., see U.S. Pat. No. 4,741,645), and flexible bag-like structures that are not inherently shape stable, to be used in the place of traditional rain gutters (e.g., see U.S. Pat. No. 4,446,658). However, the prior art does not contemplate means for forming rain gutters cut to desired longer lengths from long lengths of plastic materials that is in a form that facilitates shipment while at the same time producing shape stable gutters which have an appearance acceptably like that of traditional gutter designs. Neither has it been possible to produce such structures from materials having these desired characteristics which can be readily cut and otherwise handled by the home owner or other "do it yourself" user.

Accordingly, it is an object of this invention to provide means for producing continuous plastic rain gutters.

Another object of this invention is to supply materials from which rain gutters satisfying the foregoing objective may be made in comparatively long, continuous lengths.

Yet another object of this invention is to supply stock for the fabrication of rain gutters satisfying one or more of the foregoing objectives in a configuration which makes it convenient to be shipped and handled.

Another object of this invention to supply rain gutters satisfying one or more of the foregoing objectives made from supply stock which, after having been released from the configuration in which it was shipped, resumes the desired configuration for a rain gutter that it had before being altered into its desired shipping configuration.

It is a further object of this invention to supply rain gutters satisfying one or more of the foregoing objectives which may be assembled and installed at the installation site.

Still another object of this invention is to supply rain gutters satisfying one or more of the foregoing objectives from stock which is susceptible to being supplied in roll form in long lengths.

Another object of this invention is to supply rain gutters from materials which facilitate assembly and installation by persons who are comparatively unskilled technically.

STATEMENT OF INVENTION

Desired objectives may be achieved through the practice of this invention, embodiments of which include rain gutters made from materials which are substantially entirely deformation reversible to enable them to be formed into desired natural configurations, rolled up in their long dimension into a coil and later unrolled without substantial residual deformation from their natural configuration due to having been rolled up. Preferred materials for use in carrying out this invention are plastics. Preferred embodiments comprise an elongated wall-facing structure and an elongated main body structure. The constituent members of both of these structures in their natural configuration, are wall-like, elongated, and, optionally, shaped and/or flat in their short dimension. They are adapted for being arrayed seriatim, long edge to long edge, with respect to each other at junctures therebetween which are substantially impervious to the flow of water, with said members retentively disposed in positional relationship with respect to each other to form, in the aggregate, an open-topped rain gutter trough for receiving and channeling rainwater. The main body assembly itself may comprise one or more such constituent members. The junctures between the wall-facing structure and the main body structure and between the constituent elements of both comprise a flexible interconnection which, optionally, may be formed as a co-extrusion simultaneously and integrally with the elements which it interconnects from the same or different plastic material, cooperating hinge elements, bead and socket structures, flexible corners, or other functionally equivalent means by which they are rendered impervious to the transmission of water and by means of which those members may be oriented into desired orientations with respect to each other to form said trough. Other preferred embodiments include rain gutter members which are substantially continuous and open-topped, and may, in cross-section, be "U", "W", or "V" shaped and/or arcuate.

DESCRIPTION OF DRAWINGS

This invention may be understood from the description herein set forth and from the accompanying drawings, in which:

FIG. 4 is a cross-sectional view of another embodiment of this invention, FIG. 5 is a perspective view of a bracket member useful in connection with embodiments of this invention, FIG. 6 is a perspective view of another embodiment of this invention, FIG. 7A is a cross-sectional view of the embodiment of this invention shown in FIG. 6, FIG. 7B is another cross-sectional view of the embodiment of this invention shown in FIG. 6, FIG. 8 is a perspective view of another embodiment of this invention, FIG. 9 is a cross-sectional view of yet another embodiment of this invention.

FIG. 10 is a cross-sectional view of another embodiment of this invention,

FIGS. 11A and 11B are cross-sectional views of another embodiment of this invention FIG. 12 is a cross-sectional view of another embodiment of this invention, and FIG. 13 is a perspective view of yet another embodiment of this invention.

DESCRIPTION OF PREFERRED EMBODIMENTS

Figure 1:
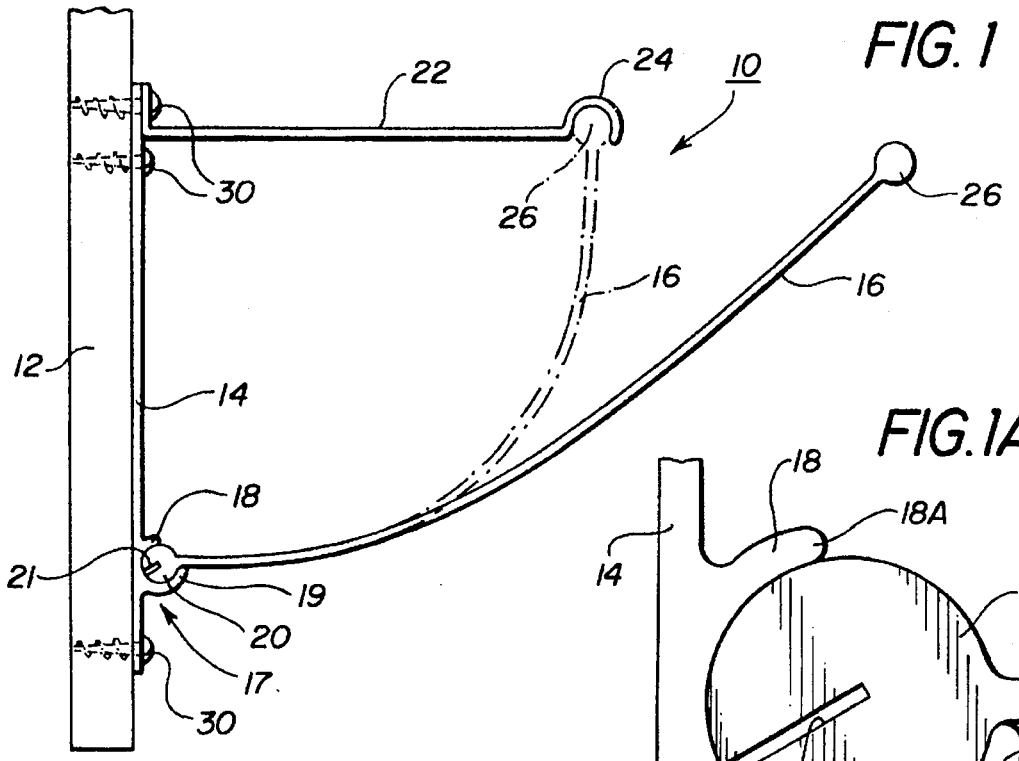
FIG. 1 is a cross-sectional view of an embodiment of this invention.

In the context of this invention, this Specification and the accompanying claims, various terms and expressions are used and, consistent with the meanings normally given to them in general and in the cognizant industries and fields of technology, are intended to be given the following meanings.

The term "wall-facing structure" is intended to mean that part of a rain gutter embodiment of this invention that is to be juxtaposed (usually oriented substantially vertically) and fastened (whether directly, or by means of hangers or other holding structures) to the wall of the structure (typically the "fascia" board) on which the embodiment is, or is intended to be positioned when in use as a rain gutter. Although such a wall-facing structure usually will be comprised of a single, elongated constituent member, it is within the contemplation of this invention that such a wall-facing structure may be comprised of more than one such constituent members. Although usually flat planar, such member(s) may be of any of a variety of cross-sectional configurations and/or orientations with respect to each other and/or the building surface to which the gutter is affixed.

The term "main body structure" is intended to mean the constituent member or, collectively, the constituent members, of the completed gutter structure which, together with its associated "wall-facing structure", form (s) the water-carrying trough part of the rain gutter. Although usually such a main body structure will be comprised of more than one elongated constituent members, it is within the contemplation of this invention that such a "main body structure" may be comprised of one or more individual panels or constituent members. Such member(s) may be of any of a variety of cross-sectional configurations and/or orientations with respect to each other and/or the building surface to which the gutter is affixed.

The term, "trough", or "trough-shaped" in cross-section, (for a rain gutter) is intended to mean the channel for transporting water along the length of the gutter. In selected embodiments of this invention, it may be formed by its "wall facing structure" and its "main body structure" when the rain gutter is in position for use, having one or more openings, normally at or near the top, which provide means by which water may be admitted into the gutter. Optionally, all or part of each such trough may be formed from a continuous elongated member. Embodiments, which may be substantially in the shape of a "U", or a "V", or a "W" or a square, or a rectangle, or a sector of a circle, or of any other regular or irregular geometric shape, are all within the contemplation of this invention as being "troughs" or "trough-shaped".

The term "substantially" as used herein is intended to mean that although the condition or state of affairs to which that term refers is not or may not be literally totally so, any variance therefrom does not materially adversely affect the desired effect what would result but for that variance. Thus, for example, some of the interconnection means herein described (e.g., web-like plastic hinges) normally will be completely impervious to the passage of water therethrough. Others may exhibit the passage therethrough of amounts of water which, in the context of the circumstances in which they are being used (i.e., out-of-doors, in rain, etc.) are inconsequential in terms of the overall operation of the structure. Thus, in either event, the interconnection means are aptly described herein as being "substantially impervious to the passage of water therethrough".

The term "interconnection means" is intended to mean any structural element(s) having the effect of perfecting a substantially water-impervious "juncture" between the constituent members of structures embodying this invention when forming the trough of a rain gutter, whether between members of a wall-facing structure alone, or of a main body structure alone, or are between a main body structure and a wall-facing structure, with said elements in edge-to-edge seriatim relationship to each other and positioned at desired angular dispositions with respect to each other. Thus, this includes (without limitation) plastic webs (whether whether of the same or different material of the members it interconnects, or co-extruded with one or both of such members or added later), and hinge-like interconnection units which are integral with or are supplementary to the members which they interconnect.

The term "edge to edge seriatim relationship" (e.g., between the constituent members of a main body structure and/or a wall-facing structure) is intended to mean that the constituent members to which the term refers are arrayed side by side, with the long edges of adjoining members juxtaposed to each other.

The term "juncture" is intended to means a join, joint, articulation, connection or seam between the juxtaposed edges of the constituent members of an embodiment of this invention, such as between a main body structure and/or a wall-facing structure of an embodiment of this invention.

The term "substantially impervious" (e.g., to the flow of water through a "juncture") means that neither the materials forming the juncture nor any conjunction of structural elements to which said term is applied will permit significant amounts of water to pass therethrough or therepast.

The term "predetermined positional relationship" is intended to mean that the structures and/or the constituents thereof so described are retainably positionable in location, orientation and/or angular orientation as desired with respect to each other.

The term "elongated" is intended to mean that the item so described has a dimension that is many times greater than the dimension that is at right angles to it: the former constituting its "long dimension" and the latter its "short dimension". Typically, in embodiments of this invention, the term "long dimension" as applied to rain gutters means the dimension, when the rain gutter is in place for desired use, along which the rain water collected by it travels.

The terms "panel" and "strip" are intended to mean material in a form which is elongated and, compared to its other dimensions, is relatively thin.

The term "flat in the long dimension" (as applied to a an element of embodiments of this invention, such as a wall facing or main body structure, a "panel" or a "strip") is intended to mean that in its long dimension, the configuration of the item referred to is such that it in its normal configuration, it will lie flat on a flat planar surface, even though, in its "short" dimension, it is of any desired cross-sectional shape including (without limitation) flat, regularly and/or irregularly curved, angled, etc.

The terms "coil" and "roll" (e.g., of strip or panel material) is intended to mean that the item so described has been wound in its long dimension to form a coil or roll, usually into a comparatively tightly wound (albeit large cored) toroid shape. Correspondingly, "coilable" and or "rollable" means susceptible to being formed into such a roll or coil.

The term "plastic" (material) means a synthetic polymeric material whose physical dimensions and/or physical characteristics may be fixed and/or altered upon the application of influences such as heat, exposure to chemicals, etc.

The terms "elastic elongation" and "reversible deformation" (as applied to plastic materials) are intended to mean the ability to recover substantially entirely from alterations of dimensions and/or configuration induced by externally applied forces after those forces have been removed.

The terms "elastic deformation" and "residual deformation" (as applied to plastic materials) is intended to mean the inability to recover substantially entirely from alterations of dimensions and/or configuration induced by externally applied forces after those forces have been removed.

The terms "natural configuration" and "normal configuration" (as applied to plastic constituents of embodiments of this invention) are intended to mean the physical configuration and dimensions which a structure made from plastic material will assume in the absence of stress or other deforming force(s) being applied to it. Usually, these are their "as formed" or "as extruded" configurations and dimensions.

The term "memory" (as applied to plastic materials) is intended to mean the inherent ability of plastic material that is under the influence of external forces, such as bending, stress, etc., to resume its natural or normal configuration upon the influence of that force being removed. Thus, an elongated strip of plastic of any shape or configuration as its normal or natural configuration, whether arcuate, curved, angled, flat, or any other regular or irregular shape or combinations of shapes, that has the "memory" to recover its natural or normal configuration, which has been coiled into a toroidal shape and thereby flattened or otherwise distorted into a flat planar condition while so coiled, will, upon release from that coiled condition, return to that natural or normal configuration, i.e., the configuration and dimensions it had prior to being subjected to the deforming forces to which it became subject by the coiling operation.

In FIG. 1, there is depicted a cross-sectional view of a rain gutter structure 10 which embodies this invention, after it has been attached to the to the fascia board 12 of a building by fastening means, such as screws 30, nails, etc. As shown, it includes a wall-facing structure 14 that is physically interconnected with a main body structure 16. In that Figure, the main body structure 16 is shown as a single structural member. However, as will be apparent from other portions of this specification, the main body structure and/or the wall-facing structure in embodiments of this invention may be made up of more than one structural member. Further, where the either or both the main body structure and the wall-facing structure is comprised of more than one component member, those members, as well as the structures themselves of which they are comprised, may be physically discrete from each other with cooperating interconnection means therebetween of any of the types hereinbefore described as falling within the meaning of "interconnection means".

The main body structure 16 and the wall-facing structure member 14, as in other embodiments of this invention, are shown as being made from elongated strips of material that is "rollable" or "coilable"; i.e., capable of being rolled up in the long dimension into coils, without therefore becoming permanently distorted or "set" in a curve by the fact of having been rolled and of being uncoiled with substantial recovery of its original, pre-coiled, normal configuration. That is, the material is capable of accommodating the elastic elongation to which it is exposed without substantial residual elastic deformation. Such a material preferably is plastic, possessing such characteristics as ease of forming, stability, and "memory" for its normal or "as formed" configuration. However, other materials which exhibit such characteristics may also or alternatively be used.

In the embodiment shown in FIG. 1 includes interconnection means for interconnection its wall-facing structure with the main body structure. One of the components of this interconnection means is a receiving socket member 17 that is integral with the wall-facing structure and is oriented in the direction of the long dimension of its lower long edge. The socket 17 is in the shape of an elongated cylinder and includes a slit that extends along its length and is oriented to face upward when the wall-facing structure is affixed to the fascia board 12. As such, it is capable of receiving and pivotally retaining the bead 20 which forms another component of the interconnection means and is integral with the long edge of the main body structure 16. It is of corresponding shape and dimensions to the inside of the socket member 18. As shown in this Figure and in greater detail in FIG. 1A, the bead 20 may include a slot 21. This enables the bead to be more easily compressed to facilitate its insertion into the socket 17 on the wall-facing structure in which it is to be held.

Figure 1A:
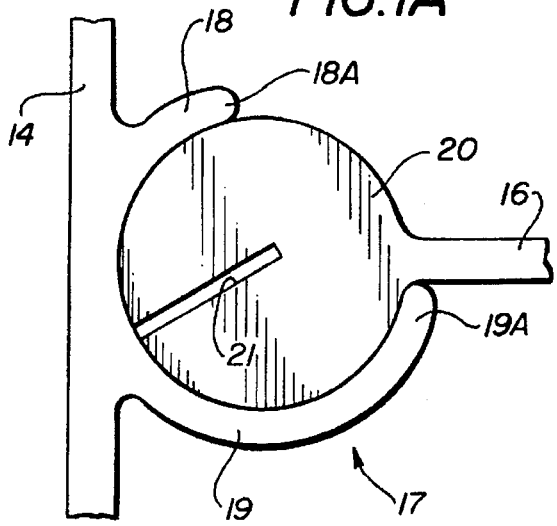
FIG. 1A is a detail drawing of a portion of embodiments of this invention.

Structural details of the socket member 17 are shown in greater detail in cross-section in FIG. 1A. It is to be understood, however, that such socket structures of the type shown are not intended to be limited to this exact embodiment but are applicable as is appropriate to other embodiments of this invention, including (without limitation) those further disclosed herein. In the embodiment shown in FIG. 1A, the composition and geometry of the upper arm 18 and of the lower arm 19 of the socket member 17 should be noted. Compositionally, they are made from plastic which is selected for its flexibility (coilability) and memory, as also is the rest of the wall-facing structure strip with which it is integrally formed. Therefore, its arms 18 and 19 are capable of being spread open temporarily to receive the bead 20 of the main body structure as it is inserted into it. This feature makes it possible to package the wall-facing structure 14 and the main body structure 16 as separate coils of elongated flat strips until such time as they are to be installed, when they can then be unrolled and the bead 20 of the main body structure 16 inserted into the socket member 17. Another method of assembly of the constituent parts which avoids difficulties which might attend joining these components in the field is for the strips constituting each assembly to be joined at the factory and then reeled up as a single coil for shipment to the installation site. This method may be further facilitated using side-by-side extrusion and other fabricating facilities to produce the strips which form the constituent elements.

Geometrically, as shown in these Figures typically the arms 18 and 19 collectively, in cross section, describe 180 degrees of angular disposition more or less. By this means, when the main body structure bead 20 is positioned within the socket member 17 and the floor member of the main body structure 16 is in its substantially horizontal position as shown in FIG. 1A, the main body structure 16 is supported by the tip end 19A of the arm 19 acting in concert with the arm 18. At the same time, the main body structure 16 is capable of being pivoted (counterclockwise, as shown in FIG. 1A) until it impinges upon the tip end 18A of the upper socket arm 18. This feature, as will be apparent from the discussion which follows in connection with FIG. 4, enables the main body member 16 to be swung upward so that the strip from which it is formed is substantially parallel to to the strip which forms the wall-facing structure 14. In that posture, having been joined together, both of these elements may be coil-wound simultaneously and shipped as a pre-combined unit, to be simultaneously cut to the desired length at the point of sale and/or at the installation site. The "ball and socket" nature of this linear interconnection also allows for the two elements to "creep" with respect to each other and thereby to accommodate factors such as their comparative radius differences as they are coiled up as well as thermal creep induced when the completed rain gutter is exposed to varying sun, wind and other heating and cooling effects. In that connection, as with other embodiments of this invention, to minimize distortion stresses and "creep" when in the coiled form, it may be desirable to wind such a completed assembly, onto reels or spools of relatively large diameter (e.g., 20 inches±).

While thus providing pivotable interconnection means that can be completed in the factory as well as at the installation site, structures of this type provide an interconnection which is substantially impervious to the passage of water since the geometry is such that water is substantially entirely blocked from being able to pass through it. Further, when the floor member of the main body structure 16 is in the "down" position shown in FIG. 1A, even though there may be play room or spaces between the juxtaposed surfaces of the bead and the socket, the gravitationally induced pressure of the main body structure 16 on the tip 19A of the socket arm 19 effectively blocks the passage of any significant amounts of water. This result may be enhanced by so fashioning the outermost tip 19A that it is more or less linear, or at least very narrow, edge for contact with the portion of the main body structure 16 which bears down upon it. By so reducing the area of the surface of the tip portion 19A, effectively, for a given weight bearing down upon it, the weight per unit area, and therefore the water sealing effectiveness of these constituent parts, may be increased. These sealing effects, as well as the ability of the constituent parts to "creep" with respect to each other, may be further enhanced by placing a sealant, such as a long-life silicone grease, on the joined parts.

After the wall-facing structure of the device as shown in FIG. 1 has been affixed to the fascia board 2, the main body structure 16, with its outer edge oriented upwards as shown to render the structure into a trough-like receptacle, may be secured in that position by clamps 22. These clamps or other support means, in connection with this embodiment as well as with respect to other embodiments of this invention, may be located at such frequent intervals along the fascia board that the tendency of the gutter to bulge or otherwise distort, as from the weight of water contained in it, is substantially overcome. The clamp 22 may be screwed or otherwise attached at one end to the fascia board and, at the other end, interconnected by means of its socket 24 to the correspondingly shaped bead 26 on the outside end of the main body structure 16, to which it optionally may then be affixed by means of screws or other fastening means. In that posture, the assembly provides a rain gutter that is substantially trough shaped receptacle that has an open top to receive rainwater falling from the associated roof.

Since structures in accordance with this invention are usually intended to be permanent installations, the other hardware associated with the various embodiments of this invention, such as downspout fittings and downspouts, corner members, etc. can be provided from materials which are compatible in shape, size, texture, appearance and composition with the structures themselves. Thus, although they might normally be made from plastic materials, such accessories may be made from such materials as aluminum since they do not usually present packaging and shipping problems requiring elasticity and memory. They may be formed by known per se means, such as compression molding, bending, etc., and known per se joining techniques and materials, such as screws, nuts and bolts, riveting, soldering, adhesive cement, etc. of the type used to connect plastic, metals and other forms of piping and other water handling apparatus, may be used.

Figure 2:
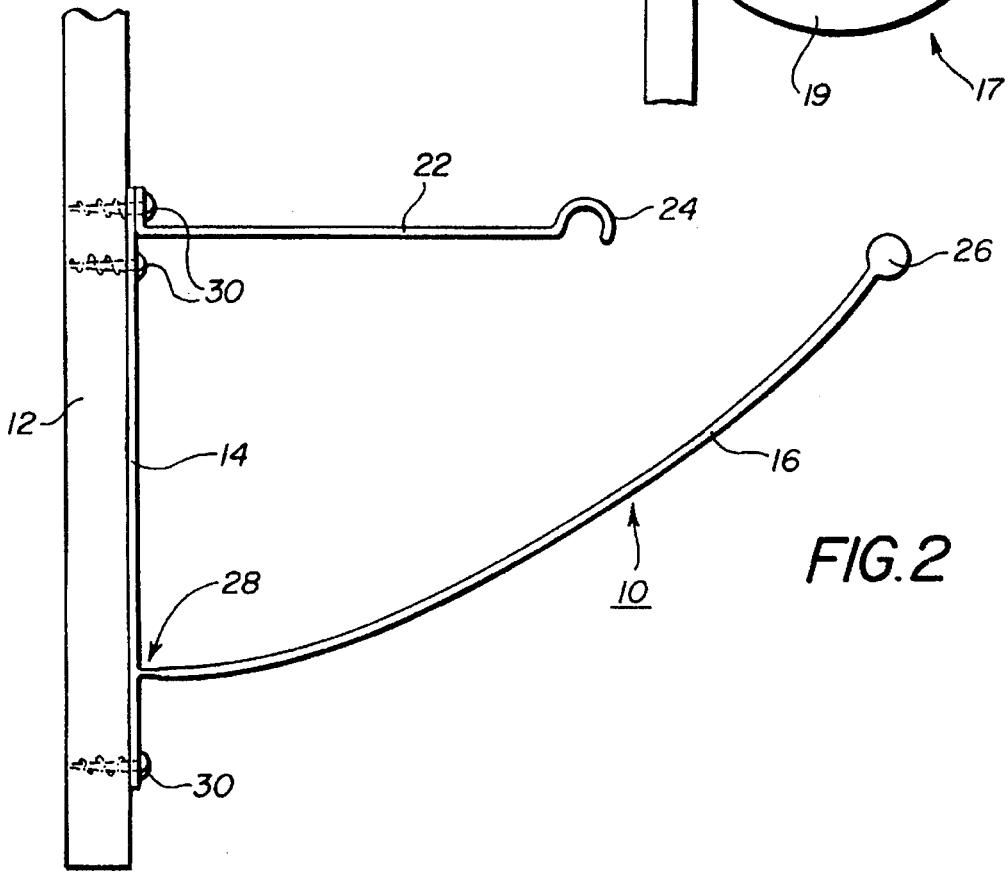
FIG. 2 is a cross-sectional view of another embodiment of this invention.

FIG. 2 illustrates an embodiment of this invention which is similar to that illustrated in FIGS. 1 and 1A. However, in this embodiment, the interconnection means between the wall-facing structure 14 and the adjacent long edge of the main body structure 16 is formed by a continuous sheet or web 28, that may be made from flexible material, such as plastic. The web 28 may be made from material which is the same as, or is different from, the material of the panels which it interconnects. Optionally, it may be of reduced thickness and/or may be integrated with the panels that it joins after they are formed or made integral therewith by concurrent extrusion. By such selections of materials and/or by structural characteristics, selected regions of flexure may be created whereby desired angular dispositions of adjacent constituent elements may be achieved. These variants, and methods, apparatus and materials for producing them are known per se and are capable of being engineered in this context to achieve desired characteristics such as durability, flexibility, impermeability to water, etc. Thus, these interconnection structures can be formed from material that is selected for having greater flexibility and less rigidity than the adjacent members of the main body structure 16 and/or the wall-facing structure 14. They may be formed as a "co-extrusion" or part of the same extrusion process as that in which the panel elements themselves are formed, using apparatus and techniques that are known per se. It is to be understood that such interconnection means or their functional equivalent (e.g., the bead and socket combination described above, and other such means as described elsewhere in this Specification), and various combinations of them, may as well and/or alternatively be used as interconnection means in any embodiments of this invention, whether between those members comprising the main body structure and/or the wall-facing structure, or between those structures themselves.

Figure 3:
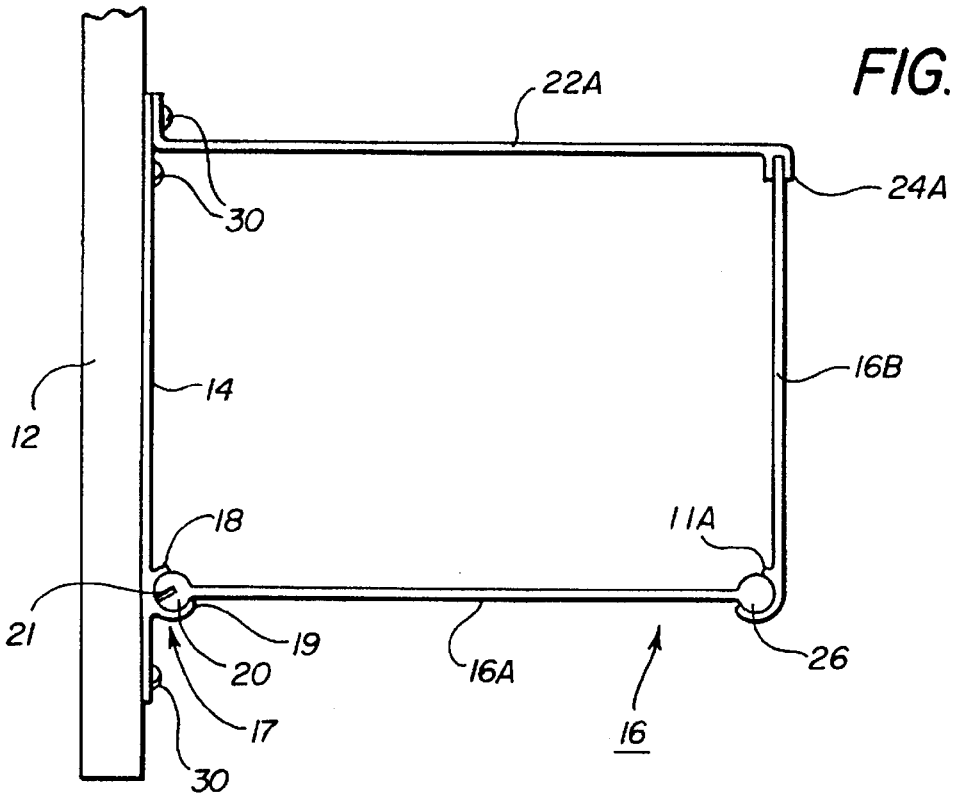
FIG. 3 is a cross-sectional view of still another embodiment of this invention.

FIG. 3 illustrates in cross-section another embodiment of this invention. This embodiment consists of a main body structure 16 which is interconnected with its associated wall-facing structure 14. The main body structure itself consists of a first constituent member strip 16A and a second constituent member strip 16B in long edge to long edge seriatim relationship with each other. Although the main body structure of some embodiments of this invention will consist of not more than two such members, it is within the contemplation of this invention that any number of such members may, in the aggregate, comprise the main body structure of embodiments of this invention. One long edge of the member 16A is pivotally interconnected with member 14 of the wall-facing structure and the other of its edges is pivotally interconnected with the other main body member 16B. As shown, both of these interconnections are created by pivotable interconnection means comparable to that shown in FIG. 1A. However, either or both of them might be created by alternative interconnection means, such as the continuous web-like interconnections previously described, so that taken together, they form a long edge to long edge seriatim array. The wall-facing structure is affixed in position to a fascia 12 as by means of screws. 30, as is also a bracket 22A that is adapted to hold the top of the structure open. This forms the assembly into a trough-like receptacle for a rain gutter having interconnections between the constituent strips of the main body structure and between the main body structure and the wall-facing structure. An advantage of this embodiment over the one previously described is increased water carrying capacity. Once more, as was explained in connection with FIG. 1A, it is possible, within the knowledge and skills of those skilled in the cognizant arts, so to regulate the geometry and dimensions of such interconnection structures as to render them pivotable as well as substantially impervious to the passage of water therethrough.

Figure 3A:
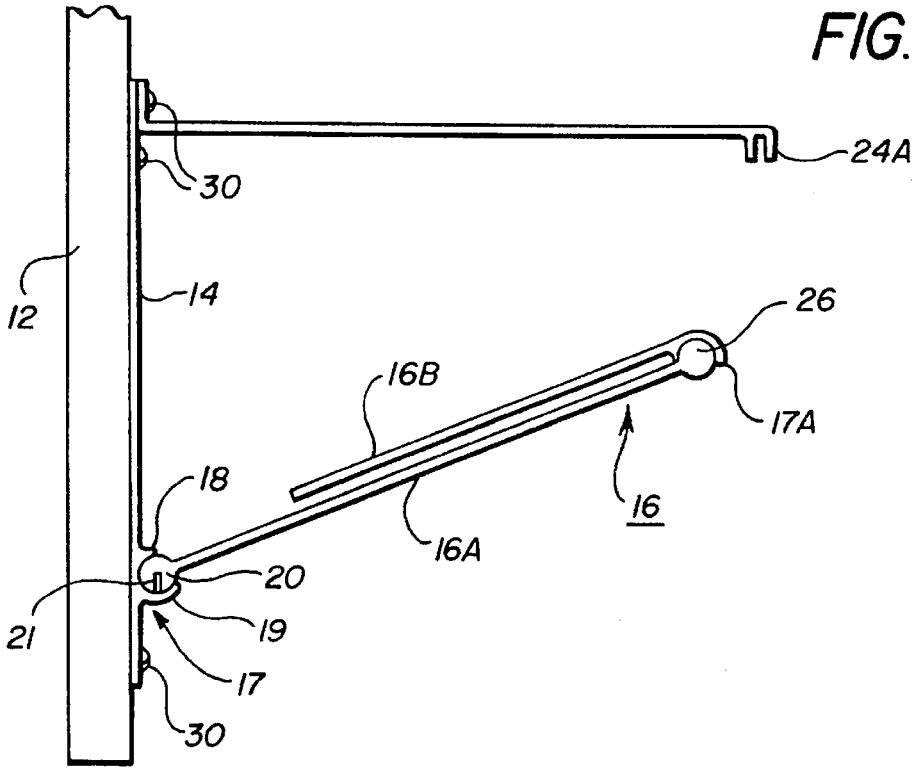
FIG. 3A is another cross-sectional view of the embodiment of this invention shown in FIG. 3.

FIG. 3A illustrates one manner of folding the constituent parts of embodiments of this invention of the type shown in FIG. 3 so that the elements 14, 16A and 16B are positioned substantially parallel to each other while the constituent elements are maintained in edge-to-edge seriatim array. In that condition, the entire assembly may be wound onto a reel or spool for ease of handling and subsequent cutting to length, at the point of sale and/or at the installation site, and subsequent installation. With interconnection means of the type shown in FIGS. 1 and 3, as well as with other interconnection means within the contemplation of this invention, it is possible to wind the individual constituent members or any combination of them into rolls, on reels or otherwise, and then to later join them together as may be necessary (depending on the type of interconnection means used), to render the various constituents into the desired final configuration as a rain gutter. It is to be noted also that the constituent components of certain of the interconnection means may be reversed: e.g., the wall-facing structure may have the bead portion of the interconnection means integral with it while the main body structure edge includes the associated socket structure, etc.

FIGS. 4 through 7B inclusive illustrate yet other embodiments of this invention which meet the several criteria set forth herein for embodiments of this invention, and yet are capable of producing a serviceable rain gutter at the intended site. FIG. 4 shows, in cross-section, one such embodiment installed on the fascia board 12 of a structure. It comprises a bracket 40 that has been affixed to the fascia board 12 by means of screws 46 through the back-wall element 47 of the bracket 40, from which (seriatim) extend a bracket base element 50 and a front wall element 48. The tops of the back wall element 47 and the front wall element 48 include a cap portion 44 which has a lip 42 extending inwardly of the bracket to form a receiving slot 43. This bracket is shown in greater detail and in a perspective view in FIG. 5.

A series of brackets of the type shown may be installed at reasonable intervals (e.g., 2–3 ft.±) down the length of the eaves of a building, for example. As is also shown in FIG. 4, this gutter assembly embodying this invention is comprised of a wall-facing structure 64 and a main body structure 60. In this case, they are illustrated as panel members 62 and 66 which have been positioned in the bracket 40 with the top edges of the wall-facing structure 64 and of the strip or panel member 62 of the main body member residing in the receiving slots 43 at the tops of the bracket elements 47, 48 respectively. The wall-facing structure 64, and the members 68, 62 which comprise the gutter assembly are interconnected at their junctures along their abutting edges by interconnection means 70, 74, which, as is the case with other embodiments of this invention, may be of the "bead and socket", "integral web", and/or other means, including (without limitation) those of the types herein disclosed, which will perform the substantial water imperviousness, coilability, and other characteristics which fall within the definition of interconnection means as set forth herein. As such, according to the type of interconnection means selected, one or more of the constituent panels or strips may be rolled up separately and interconnected at the site, or folded over on each other and rolled up collectively, for shipping, cutting to desired length, and installation at the site.

This result may be facilitated using the embodiments of this invention shown in FIG. 6 through 7B inclusive. In these embodiments, the floor member of the main body structure that corresponds positionally to the main body structure 68 shown in FIG. 4 is itself made up of panels or strips as elements 66, 67, which are arrayed long edge to long edge, seriatim and are interconnected at their junctures by interconnection means of appropriate type and design, including (without limitation) those described herein. As such, according to the type of interconnection means selected, one or more of the constituent elements may be rolled up separately and interconnected at the site, or they may be collapsed accordian-like together as is shown on FIGS. 7A and 7B, and then rolled up collectively, for shipping, cutting to desired length, and installation at the job site. This configuration of constituent elements has a further advantage. The interconnected constituent elements of the insert 60, while still abutting as is shown in FIG. 7A, may be placed upright on the installed brackets and the tops of the panel forming the back wall structure 64 and the front member 62 of the main body structure fed into the slots 43 in the tops of the bracket front wall element 48 and back wall element 47 as the juncture of the floor elements 66, 67 of the main body structure is moved downward. As shown in FIG. 7B, ultimately they arrive in position to form collectively the floor of the main body structure.

FIG. 6 further illustrates this effect, but with the added feature that in this embodiment, the base elements 50A of the brackets slope upward to their centers from where each joins the bases of its associated front element 48A and back element 47A of the bracket. Correspondingly, the inner walls of the bracket elements 47A and 48A slope away from their outer walls at their lower ends. Therefore, the members 66, 67 which collectively form the floor of the main body portion of the main body structure 60, when positioned in the brackets, as in the manner described above, retain an inverted "V" shape, the ridge of which is along their common juncture and interconnection means 72. An advantage of this feature is that it will tend to keep leaves, sticks and other debris up away from the floor of the finished structure, thereby enhancing the free flow of water along the completed gutter assembly.

FIG. 8 illustrates another embodiment of this invention that may be advantageously used. It includes reinforcing strips 82, 84, made from metal or other appropriate material, which may be incorporated into the structure of the various elements which comprise embodiments of this invention, as by having the rest of each element extruded or otherwise formed about them. By this means, such constituent elements may have their ability enhanced to withstand any tendency to bow outward in response to the weight of water between brackets or other constraining means.

FIG. 9 illustrates yet another embodiment of this invention that have some features comparable to those shown in FIGS. 4 through 8. It includes a wall facing structure 47B and a main body structure consisting of floor portion members 66B and 67B which are interconnected at their juncture with each other by interconnection means 72B, a front wall member 48B which is interconnected with the floor portion member 67B by means of interconnection means 74B, and interconnection means 70B at the juncture of the floor portion member 66B with the wall facing structure 47B. However, in this embodiment, the wall facing structure 47B extends vertically downward past its juncture with the floor portion member 66B, and provision is made for affixing the wall facing structure 47B directly to the fascia board 12. As shown in FIG. 9, this may comprise screws 46 or other fastening means 46 inserted through holes at the top and the bottom of the wall facing structure. At the same time, the fastening means 46 at the top of the wall-facing structure may also fasten one end of a bracket 22B, the other end of which is shaped into a curved socket 24B to receive a bead at the top of the front panel member 48B of the main body structure. Optionally, the junctures at the interconnection means 70B, 72B, and 74B may be so formed that the wall facing structure and the main body structure describe the "W" configuration shown in FIGS. 9 and 6, or with the floor elements 66B and 67B of the main body structure describe a flat configuration, such as those shown in FIGS. 4 and 8.

FIG. 10 illustrates yet another embodiment of this invention. In this embodiment, the support bracket 90, which is analogous (e.g.) to the bracket 40 shown in FIGS. 4 and 5, instead of having a "W" shaped cross-section for its interior floor as shown in FIG. 6, has a "V" shaped interior floor. Correspondingly, the gutter 92 with which it is to be associated and which it is to support comprises a wall-facing structure 94 that is interconnected by interconnection means 98 of any of the types contemplated herein at its juncture with the main body structure 96. The latter, in this case, is shown to be in the form of a single strip or panel member. The bracket 90 includes vertical side flanges 91 with holes 93 therein through which screws 95, nails, or other fastening means may be inserted in order to anchor the bracket 90 to a fascia board 97. In this case, as in the case of any or all of the other embodiments covered by this disclosure, the main body structure may optionally be affixed to its support bracket by means of adhesives, screws, or other affixing means, in order to secure it from being moved out of position by wind or other means. An advantage of this embodiment is its comparative ease and lowered cost to produce and to install, albeit with somewhat reduced water carrying capacity.

FIGS. 11A and 11B illustrate another embodiment of this invention, designed to be held in "V" shaped brackets 110 which are somewhat like those shown for use with the embodiments illustrated in FIG. 10 except that they include a groove 111 at the base of the "V" and beads 112 at the tops of the brackets to accommodate corresponding portions of the embodiment of this invention to be associated therewith. That embodiment includes a wall facing structure 114 and a main body structure 115 at the juncture between which is interconnection means 116 and, optionally, an anti-sagging structure comprising a bead joined to the adjoining edges of the wall facing structure and the main body structure by means of a web 118. The opposite or top edge of the wall facing structure and of the main body structure optionally include loops 120, 119 to engage and retain the top beads 112, to further support of the rain gutter trough when it is in place on the brackets. Some of the advantages of this embodiment may be seen from FIG. 11B, which shows the completed structure, with the wall facing structure and the main body structure pivoted toward each other about the interconnection means 116 to aligned them substantially parallel to each other for purposes of being rolled into a coil for shipping, storage, etc. until cut to desired lengths for installation and use. As is the case with other embodiments of this invention, the constituent portions of this embodiment are made from materials, preferably plastics, which are selected for having memory for their normal configurations and elastic deformability characteristics such that they will, upon withdrawal of deforming forces, resume their normal configuration. Therefore, when subsequently uncoiled and cut, a trough-like rain gutter will result that is substantially of the desired geometric configuration in which it was originally formed.

FIG. 12 illustrates another embodiment of this invention, which comprises a wall facing structure 200, and a main body structure 202 which are joined by interconnection means 203. Again, as was the case with the embodiment illustrated in FIG. 10 and 11, the basic configuration of this embodiment is substantially that of a "V", but, as in the case of the embodiment shown in FIG. 9, the bottom edge of the wall facing structure 200 extends below its juncture with the main body structure 202, so that through insertion therethrough of a screw 46, or by other known per se fastening means, and by the use corresponding fastening means at its top, the embodiment may be affixed to a fascia board 12. To keep the structure from flaring open too far at the top, the upper fastener 46 may also fasten down one end 205 of a bracket 206, the other end 207 of which is adapted, as by being curved, to retainably accept a bead 208 or other interconnecting means located at the top edge of the main body structure 202. Among the advantages of this embodiment is that it affords the ease of packaging and handling in the way described with respect to the embodiment shown in FIG. 11B, but without the necessity of separate, underlying support means of the type shown in FIG. 11A. It also has the advantage, as do also the "U", "W" and other cross-sectional shape variants herein described, of providing enhanced "beam" strength for resistance against mid-span bowing or downward deflection. The choice of the exact materials, design, composition, geometry, dimensions and configurations used normally will be dictated by considerations that are within the competence of those skilled in the arts, given the considerations of intended use, ease of coiling and handling, etc.

FIG. 13 illustrates yet another rain gutter 300 which is an embodiment of this invention. This embodiment, as shown, is formed from a single member into a configuration that is substantially arcuate and semi-circular in cross-section. While this is a traditional configuration for rain gutters, as an embodiment of this invention this exact configuration is not to be construed as by way of limitation, since alternative single unit embodiments may, in cross-section, be "U", "W", or "V" shaped and/or arcuate configurations. As such they are also characterized by being made from materials which are substantially entirely deformation reversible to enable them to be formed into desired natural configurations, rolled up in their long dimension into a coil and later unrolled without substantial residual deformation from their natural configuration due to having been rolled up, and with residual memory by which, upon release from external influences such as the tresses and disfigurements of coiling, they will resume their natural, "as-formed" configurations. Plastics known to exhibit these characteristics and water imperviousness are preferred materials from which to make these as well as other embodiments of this invention.

From the foregoing descriptions and discussions it will be clear that embodiments of this invention make it possible to mass produce rain gutter structures in a wide variety of embodiments which are easy and efficient to ship and handle, and yet are easily installed in long, continuous, aesthetically acceptable, and durable lengths. Thus, it is to be understood that the embodiments herein disclosed, discussed and illustrated are by way of illustration and not of limitation and that this invention may be practiced in a wide variety of applications and embodiments without departing from the spirit or scope of this invention.

We claim:

1. A rain gutter comprising a trough-like structure comprised of at least one elongated member, each of which constituent members is made from material by which said member is rendered (1) formable into desired natural configurations, (2) coilable in its long dimension after having been formed into desired natural configurations without substantial residual elastic deformation from its natural configuration due to having been so coiled, and (3) uncoilable, said material being substantially impervious to the passage of water therethrough and having residual memory which causes each such member formed from it, after being coiled and uncoiled, and while being unaffected by external influences, to resume its natural configuration.

2. The rain gutter described in claim 1 formed from a single continuous plastic member.

3. The rain gutter described in claim 1 formed from more than one continuous plastic members.

4. A rain gutter device comprising an elongated wall-facing structure and an elongated main body structure, each of said structures being comprised of at least one constituent member, said members being elongated and arrayed with their long edges in edge to edge seriatim relationship with respect to each other with interconnection means for interconnecting adjacent long edges thereof and for rendering the juncture therebetween substantially impervious to the passage of water therethrough, said members being retentively disposable in desired positional relationship to each other to form a trough shaped rain gutter, said members and said interconnections being made from materials by which they are rendered (1) formable into desired natural configurations, (2) coilable in their long dimension after having been formed into desired natural configurations without substantial residual elastic deformation from their its natural configuration due to having been so coiled, and (3) uncoilable, said material being substantially impervious to the passage of water therethrough and having residual memory which causes each such member and interconnection means formed from it, after being coiled and uncoiled, and while being unaffected by external influences, to resume its natural configuration.

5. The device described in claim 4 wherein said wall-facing structure, said main body structure, and said interconnection means are made substantially entirely from plastic materials.

6. The device described in claim 5 wherein said interconnection means comprises a continuum between said members.

7. The device described in claim 6 wherein said interconnection means, said main body structure, and said wall-facing structure are all parts of a common plastic extrusion.

8. The device described in claim 4 wherein the edges of the members of selected among said members which adjoin each other include cooperating constituents of said interconnection means.

9. The device described in claim 5 wherein the edges of the members of selected among said members which adjoin each other include cooperating constituents of said interconnection means.

10. The device described in claim 8 wherein, among at least some of said adjacent pairs of edges, said constituents of said interconnecting means include an elongated cylindrical socket element that is integral with one of said edges and has an axially oriented slit for insertion therein of an edge bead that is integral with the long edge of the other of said edges and is of dimensions corresponding to those of the interior of said cylindrical socket element.

11. The device described in claim 9 wherein, among at least some of said adjacent pairs of edges, said constituents of said interconnecting means include an elongated cylindrical socket element that is integral with one of said edges and has an axially oriented slit for insertion therein of an edge bead that is integral with the long edge of the other of said edges and is of dimensions corresponding to those of the interior of said cylindrical socket element.

12. A rain gutter device comprising an elongated wall-facing structure comprised of one constituent member, an elongated main body structure comprised of at least one constituent member, said members which comprise both said wall facing structure and said main body structure being elongated and arrayed with their long edges in edge to edge seriatim relationship with respect to each other, and interconnection means at each of the junctures between the constituent members of said wall facing structure and said main body structure and at the juncture between said structures which render each of the junctures therebetween substantially impervious to the passage of water therethrough, said wall facing structure, and said main body structure and its constituent members, being retentively disposable in desired positional relationship with respect to to each other to form a trough shaped rain gutter, said device being made from materials by which its constituent members and their associated interconnection means are rendered (1) formable into desired natural configurations, (2) coilable in their long dimension after having been formed into desired natural configurations without substantial residual elastic deformation from their natural configuration due to having been so coiled, and (3) uncoilable, said material being substantially impervious to the passage of water therethrough and having residual memory which causes each such member and interconnection means formed from it, after being coiled and uncoiled, and while being unaffected by external influences, to resume its natural configuration.

13. The device described in claim 12 made substantially entirely from plastic materials.

14. The device described in claim 13 wherein said interconnection means comprise continuums between said members.

15. The device described in claim 14 wherein said interconnection means, said main body structure, and said wall-facing structure are all parts of a common plastic extrusion.

16. The device described in claim 12 wherein the edges of the members of selected among said members which adjoin each other include cooperating constituents of said interconnection means.

17. The device described in claim 13 wherein the edges of the members of selected among said members which adjoin each other include cooperating constituents of said interconnection means.

18. The device described in any of claims 1 through 17 inclusive in combination with bracket means for retaining said device when installed in its trough like shape.

19. A method of making a rain gutter comprised of least one elongated constituent member comprising the steps of selecting material from which to form each constituent member of said rain gutter by which material each of said members will be rendered (1) formable into desired natural configurations, (2) coilable in its long dimension after having been formed into desired natural configurations without substantial residual elastic deformation from its natural configuration due to having been so coiled, and (3) uncoilable, said material being substantially impervious to the passage of water therethrough and having residual memory which causes each such member formed from it, after being coiled and uncoiled, and while being unaffected by external influences, to resume its natural configuration and forming an elongated, trough-like rain gutter structure that is substantially impervious to the passage of water therethrough from at least one elongated member made from said material.

20. The method described in claim 19 wherein said step of forming said rain gutter structure comprises forming it from a single continuous plastic member.

21. The method described in claim 19 wherein said step of forming said rain gutter structure comprises forming it from more than one plastic members.

22. A method of forming a rain gutter device that is substantially trough shaped in cross-section comprising the steps of forming an elongated wall-facing structure and an elongated main body structure from at least one elongated member each, with said members arrayed in long edge to long edge seriatim relationship to each other, and forming interconnections between said members by which said members may be positioned at a predetermined angle with respect to each other and through which water is substantially unable to pass both of the aforesaid steps being carried out using materials by which said members and the means for forming said interconnections are rendered (1) formable into desired natural configurations, (2) coilable in their long dimension after having been formed into desired natural configurations without substantial residual elastic deformation from their natural configuration due to having been so coiled, and (3) uncoilable, said material being substantially impervious to the passage of water therethrough and having residual memory which causes each such member and interconnection means formed from it, after being coiled and uncoiled, and while being unaffected by external influences, to resume its natural configuration.

23. The method described in claim 22 wherein said step of forming said main body structure is carried out using at least two such members.

24. The method described in claim 22 wherein said steps of forming said structures and said interconnections is carried out using plastic materials.

25. The method described in claim 23 wherein said steps of forming said structures and said interconnections is carried out using plastic materials.

26. The method described in claim 24 wherein said step of forming said interconnections is carried out using continuums of material between said members.

27. The method described in claim 25 wherein said step of forming interconnections is carried out using continuums of material between said members.

28. The method described in claim 26 wherein said steps of forming at least some of said continuums are carried out simultaneously as part of a common plastic extrusion with at least one of the members they interconnect.

29. The method described in claim 27 wherein said steps of forming at least some of said continuums are carried out simultaneously as part of a common plastic extrusion with at least one of the members they interconnect.

30. The method described in claim 25 wherein said step of forming said interconnections includes the step of forming an elongated cylindrical socket element that is integral with one of the members that are interconnected by that interconnection and has an axially oriented slit for insertion therein of an edge bead that is formed along the long edge of the other of said members and is of dimensions corresponding to those of the interior of said cylindrical socket element.

* * * * *